US006691898B2

(12) United States Patent
Hurray et al.

(10) Patent No.: US 6,691,898 B2
(45) Date of Patent: Feb. 17, 2004

(54) PUSH BUTTON FOAM DISPENSING DEVICE

(75) Inventors: Paul Hurray, Akron, OH (US); Frank Leyshon, Cambridge, OH (US); Michael Karr, Medina, OH (US)

(73) Assignee: Fomo Products, Inc., Norton, OH (US)

( * ) Notice: Subject to any disclaimer, the term of this patent is extended or adjusted under 35 U.S.C. 154(b) by 0 days.

(21) Appl. No.: 09/683,886

(22) Filed: Feb. 27, 2002

(65) Prior Publication Data

US 2002/0074357 A1 Jun. 20, 2002

(51) Int. Cl.[7] ..... B67D 5/58; A47G 19/12

(52) U.S. Cl. ..... 222/190; 222/402.13; 222/402.14; 222/145.5; 222/514; 251/322; 251/325; 206/470

(58) Field of Search ..... 222/190, 511, 222/513, 514, 145.1, 145.5, 402.13, 402.14; 251/322, 325, 323; 137/625.38; 206/745, 747, 748, 470

(56) References Cited

U.S. PATENT DOCUMENTS 990,179 A * 4/1911 Wilson ..... 251/243
2,068,205 A 1/1937 Steckel et al.
2,890,836 A 6/1959 Gusmer et al.
3,096,001 A 7/1963 Boe et al.
3,158,292 A 11/1964 O'Donnell
3,176,922 A 4/1965 Decker
3,178,157 A 4/1965 Cole
3,303,970 A 2/1967 Breslau et al.
3,416,709 A 12/1968 Shultz et al.
3,506,159 A 4/1970 Muller
3,558,051 A 1/1971 Strickler et al.
3,559,890 A 2/1971 Brooks
3,575,319 A 4/1971 Safianoff
3,613,956 A 10/1971 McCulloch
3,620,414 A 11/1971 Phillipps
3,633,795 A 1/1972 Brooks
3,635,372 A 1/1972 Van Dyck et al.
3,690,556 A 9/1972 McCain
3,784,110 A 1/1974 Brooks
3,795,364 A 3/1974 Kattner
3,837,575 A 9/1974 Lehnert
3,976,248 A 8/1976 Middleton, Sr.
4,023,733 A 5/1977 Sperry
4,083,474 A 4/1978 Waite et al.
4,117,551 A 9/1978 Books et al.
4,133,483 A 1/1979 Henderson
4,193,546 A 3/1980 Hetherington et al.
4,262,847 A 4/1981 Stitzer et al.
4,262,848 A 4/1981 Chabria
4,311,254 A 1/1982 Harding
4,350,298 A 9/1982 Tada
4,377,256 A 3/1983 Commette et al.
4,399,930 A 8/1983 Harding
4,427,153 A 1/1984 Schaefer
4,453,670 A 6/1984 Sirovy
4,458,831 A 7/1984 Holleran et al.
4,496,081 A 1/1985 Farrey
4,505,335 A 3/1985 Hayba
4,516,694 A 5/1985 Finn
4,524,944 A 6/1985 Sussman (List continued on next page.)

*Primary Examiner*—Kevin Shaver
*Assistant Examiner*—Stephanie L. Willatt
(74) *Attorney, Agent, or Firm*—Buckingham, Doolittle & Burroughs, LLP; Louis F. Wagner

(57) ABSTRACT

The invention relates to a fluid dispensing device incorporating a push-button actuator normally biased in the closed position, a housing for receiving the aerosol canisters and a carrying case for the entire assembly. Activation is achieved by longitudinal axial compression followed by snapping engagement of the housing fitted about the aerosol valves which depresses the aerosol valves.

57 Claims, 5 Drawing Sheets

U.S. PATENT DOCUMENTS 4,529,126 A 7/1985 Ives
4,549,676 A 10/1985 Gerich
4,550,863 A 11/1985 Farrey
4,603,813 A 8/1986 Luegering
4,643,336 A 2/1987 Mandeville et al.
4,674,658 A 6/1987 Van Brocklin
4,676,437 A 6/1987 Brown
4,708,292 A 11/1987 Gammons
4,762,253 A 8/1988 Palmert
4,773,562 A 9/1988 Gueret
4,826,048 A 5/1989 Skorka et al.
4,838,458 A 6/1989 Davidson
4,867,346 A 9/1989 Faye et al.
4,880,143 A 11/1989 Murray et al.
4,901,888 A 2/1990 Standlick
4,913,317 A 4/1990 Wernicke
4,925,107 A 5/1990 Brown
4,955,544 A 9/1990 Kopp
4,958,750 A 9/1990 Palmert et al.
4,993,596 A 2/1991 Brown
5,027,975 A 7/1991 Keske et al.
5,040,728 A 8/1991 Zwirlein, Jr. et al.
5,050,776 A 9/1991 Rosenplanter
5,053,202 A 10/1991 Dwyer et al.
5,069,881 A 12/1991 Clarkin
5,074,470 A 12/1991 Rosenplanter et al.
5,090,814 A 2/1992 Petcen
5,092,492 A 3/1992 Centea
5,104,006 A 4/1992 Brown
5,129,581 A 7/1992 Braun et al.
5,242,115 A 9/1993 Brown
5,246,143 A 9/1993 Cherfane
5,265,761 A 11/1993 Brown
5,299,740 A 4/1994 Bert
5,332,157 A 7/1994 Proctor
5,339,991 A 8/1994 Snyder
5,344,051 A 9/1994 Brown
5,348,230 A 9/1994 Mullen et al.
5,425,404 A 6/1995 Dyer
5,429,308 A 7/1995 Brown
5,462,204 A 10/1995 Finn
5,568,883 A 10/1996 Cantaneo et al.
5,570,822 A 11/1996 LeMarbe et al.
5,645,199 A 7/1997 Schnitzler
5,791,522 A 8/1998 Lee et al.
5,799,876 A 9/1998 Isler
5,918,782 A * 7/1999 Shanklin et al. ..... 222/511
5,924,599 A 7/1999 Brown
6,467,657 B2 * 10/2002 Shanklin et al. ..... 222/511

* cited by examiner

FIG.-2
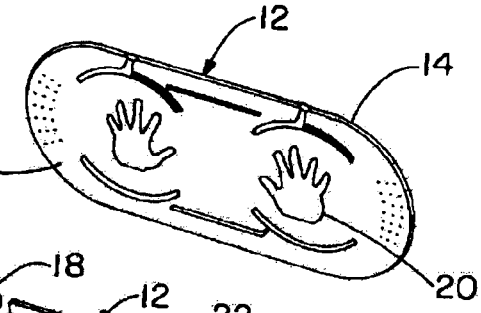
FIG.-1
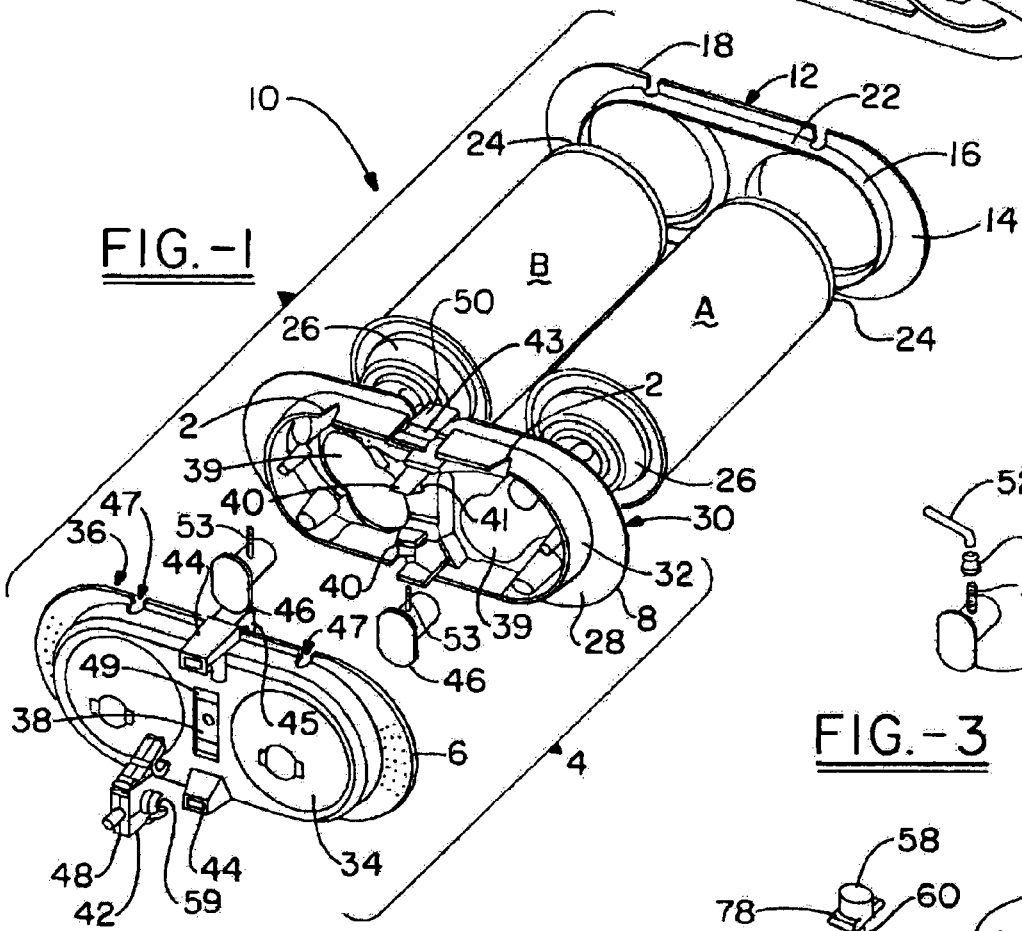
FIG.-3
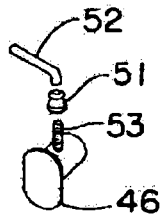
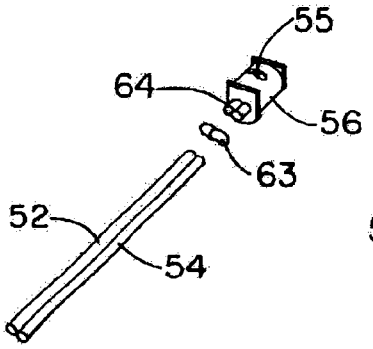
FIG.-4
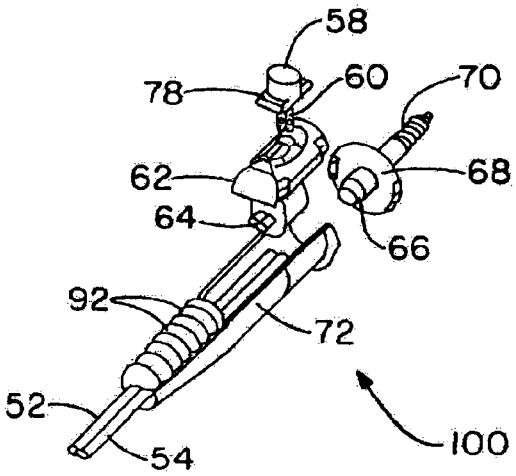
FIG.-5

PUSH BUTTON FOAM DISPENSING DEVICE

BACKGROUND OF INVENTION

The invention relates generally to a pressurized chemical dispensing apparatus, and more particularly to a hand-held apparatus particularly suitable for use in dispensing two-component systems, more particularly urethane foams, wherein the apparatus includes a push button dispensing assembly interconnected to the canister supplies. Optionally the apparatus is contained within a kit which permits one-handed operation.

The use of urethane and similar expandable foams has increased over the years for numerous applications. Urethane foams are well known as having desirable characteristics useful for many applications, such as insulation. Urethane foams are also well known for their compatibility with low cost blowing agents which allow such foams to be applied by way of pressurized containers as well as their natural adhesive qualities which allow such foams to bond excellently to any number of substrates. Typically, urethane foams are the reaction product of two individual components, one being an isocyanate and the other being a resin. These two individual components when reacted together under pressure, give the resultant foam various chemical compositions, each such composition having significant utility in a particular application. Thus, urethane foams may be specially formulated to provide a final foam which is rigid, semi-rigid or flexible.

Closed cell urethane foams have particular utility in building and structural insulation while open cell urethane foams have particular utility in packaging or non-insulating purposes. Regardless of cell structure, two-component urethane foams are typically formed by mixing the two or more individual foam components together when the foam components exit respective supply containers. Individual material supply tubes leading from each foam component container convey the foam components to a foam dispensing apparatus, such as a nozzle.

There are numerous applications in which polyurethane foam is used at a site for any number of applications in addition to its traditional use in the building trades as a source of insulation. Recently polyurethane foam has become used with increasing frequency as a sealant in the building trades for sealing spaces between window and door frames and the like and as an adhesive for glueing flooring and roof tiles and the like. The polyurethane foam for such in-situ applications is typically supplied as a one-component froth foam or a two-component froth foam. A one-component foam means that both the resin and isocyanate for the foam is supplied in a single pressurized container and dispensed from the container through a valve or gun attached to the container. A two-component "froth" foam means that one component is supplied in one pressurized container, typically the "A" container (i.e., polymeric isocyanate, fluorocarbons etc) while the resin is supplied in a second pressurized container, typically the "B" container (i.e., polyols, catalyst, flame retardants etc.). Typically two-component kits use pressurized cylinders which are connected by hoses to a dispensing gun. There are advantages and disadvantages to one-component and two-component foams. One of the advantages of the two-component system is its relatively long shelf life resulting from the fact that the chemicals are not mixed until they encounter one-another in the dispensing gun.

One application for a hand-held, portable two-component polyurethane froth foam kit exists in the mining industry. In the event of a fire in a shaft being tunneled, standard procedure is to extinguish the fire by sealing the shaft with a fire "door" and then pumping out from the shaft sealed by the door, the air in the shaft to extinguish the fire. It has been found that polyurethane foam is excellent for sealing the bulkhead or door to the tunnel. As already noted, the polyurethane foam has an adhesive characteristic and the foam can be formulated to provide a relatively quick tack free time with little permeability for gas escape. Surprisingly, the fire door is not adjacent an open flame, and whatever temperature the gases exhausted from the shaft are, they are not sufficiently high in temperature to disintegrate the foam. Because of its long shelf life, a two-component foam is ideal for this application. Standard procedure is to simply provide two-component kits at the shaft being tunneled to seal and secure the fire door or bulkhead to the shaft in the event of a fire.

Different packaging arrangements are used by different manufacturers. Many two-component kit packages use some form of tray with knock-out holes through which the hoses extend after the box is opened and the hoses attached to the cylinder's valved fitting. However, there is at least one two-component polyurethane froth foam box which utilizes cylinders equipped with "dip tubes" which extend through the outlet valve from the inside bottom of the cylinder. This allows the cylinders to be placed upright in the box instead of upside down. This carton does not use a tray and has the hoses extend out the side of the box through knock-out plugs. The carton is carried by a strap affixed to the top cover. The top cover is a flap which has to be opened and closed to gain access to the cylinder's valve after the hoses are connected to the cylinders.

What has been missing from the Prior Art however, is a foam dispensing device which couples both fail-safe operation by a two-stage activation procedure, coupled with a dispensing mechanism whereby the dispensing means is biased into a closed position.

SUMMARY OF INVENTION

The invention is directed to an easily assembled foam dispensing apparatus in which two foam component supply containers are held in place by an carrier assembly which includes a push-button dispensing assembly which is separate from the carrier assembly.

In one principal aspect of the present invention, the entire dispensing apparatus and carrier unit is contained in a carrying case. The carrying case contains two foam component supply canisters and an actuating assembly in the form of two foam component supply tubes, each having a predefined length which is sufficient to permit a dispensing assembly attached to the supply tubes to be operated remotely from the carrying case while interconnected thereto. The material supply tubes, dispensing assembly and one or more detachable dispensing nozzles are positioned within a designated area within the carrying case so that the apparatus may be sold as a single unit or kit. The case not only functions as a carrier assembly for the dispensing apparatus, but may also function as a shipping container therefor or as a display case.

In another principal aspect of the present invention, the dispensing apparatus includes a carrier which holds two foam component supply canisters in place and incorporates an actuating assembly to ensure simultaneous release of the two foam components from their respective supply canisters through foam component supply tubes. The tubes extend to a foam dispenser which includes a dispensing nozzle. The carrier is capable of holding the supply canisters in place in either an upright or inverted orientation depending on whether the canisters have a dip tube contained therein.

Accordingly, it is an object of the present invention to provide an improved foam dispensing apparatus having a foam dispensing member interconnected to two foam component supply canisters by a pair of supply tubes, the supply tubes conveying foam components to the foam dispensing member and permitting the dispensing nozzle member to operate detached from the apparatus and operated remotely from the foam supply canisters adjacent a work area.

It is another object of the present invention to provide a simple foam dispensing apparatus which can be easily operated by an ordinary consumer in which the apparatus includes a carrier member containing two upright foam component supply containers the carrier member including an actuating assembly having means for aligning a pair of material supply tubes with the foam component supply containers and actuating the same to convey foam components from the supply container to a push-button dispensing member biased in the closed position which upon activation through depression, dispenses the fluid contained within the canisters.

These and other objects of the present invention will become more readily apparent from a reading of the following detailed description taken in conjunction with the accompanying drawings wherein like reference numerals indicate the parts and appended claims.

BRIEF DESCRIPTION OF DRAWINGS

The invention may take physical form in certain parts and arrangements of parts, a preferred embodiment of which will be described in detail in the specification and illustrated in the accompanying drawings which form a part hereof, and wherein:

FIG. 1 is an assembly view of the two component system showing two aerosol cans positioned within a two part top housing plate and a bottom canister positioning plate;

FIG. 2 is a perspective view of the bottom side of the canister positioning plate;

FIG. 3 is an assembly view of a valve depressor for one aerosol dispensing valve;

FIG. 4 is an assembly view of the shut-off valve housing within the dispensing nozzle;

FIG. 5 is an assembly view of a push button dispensing nozzle;

DETAILED DESCRIPTION

Figure 6:
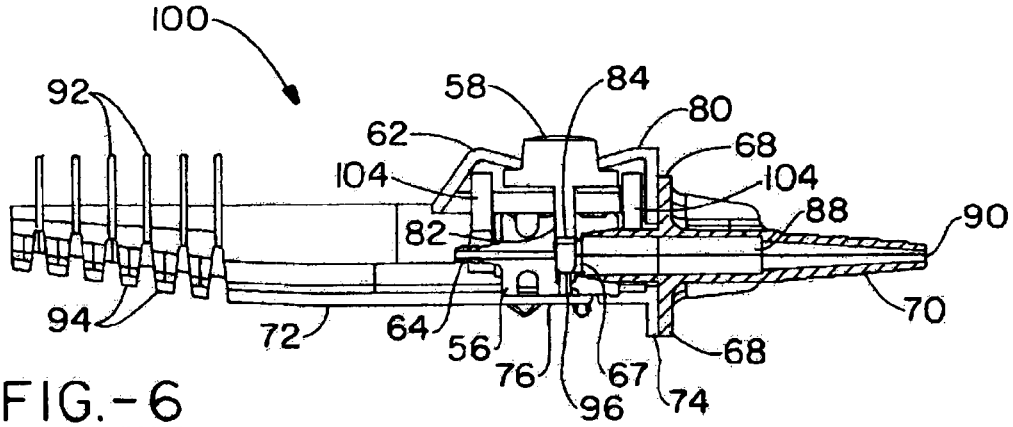
FIG. 6 is a side elevational view in partial cross-section showing the push button dispensing nozzle in the closed position.

Referring now to the drawings wherein the showings are for purposes of illustrating the preferred embodiment of the invention only and not for purposes of limiting the same, the Figures show a two-component portable polyurethane foam apparatus, optionally for inclusion in kit form. It is to be understood that the words "container" or "box" or case or kit are, for purposes of this description, identical and are used interchangeably throughout the specification in describing the combination of the two-component polyurethane foam dispensing system plus carrying case.

The portable two-component polyurethane foam kit includes two cylinders, typically an "A" cylinder, which contains a polymeric isocyanate and a "B" cylinder, which contains a polyol amine or resin. Formulations within each cylinder can vary significantly depending on the application. For example, adhesive applications produce a polyurethane foam which has very little, if any, "foam" while insulation applications use a formulation which produces a significant rise in the foam. Usually, portable, hand carried two-component polyurethane foam kits dispense the chemicals from the dispensing apparatus as a "froth" having a consistency or texture similar to that dispensed from an aerosol can of shaving cream. All such variations in the formulations of polyurethane and whether the chemicals are dispensed as a spray or froth are included within the scope of the present invention so long as the formulations are supplied in a portable, hand-carry form.

As illustrated in FIG. 1, a two component fluid (e.g., polyurethane foam) dispensing holder assembly 10 is shown illustrating an A aerosol component and a B aerosol component. The dispensing holder assembly 10 has an elongated oval canister positioning plate 12 having a top 14 and a bottom 18 side as well as an elongated oval two component top housing assembly 4 having an upper housing 6 and a lower housing 8. Canister positioning plate 12 has a pair of raised circular ridges 16 on the top side 14 of the canister positioning plate which are dimensioned for frictional engagement with either of the circular aerosol can bottoms 24. Optionally, the raised circular ridges will have an inwardly facing notch (not shown) at a bottom thereof for mating engagement with the peripherally extending canister lip when fully inserted into canister positioning plate 12. Optionally a pair of supporting ribs 22 connect each raised circular ridge at a peripheral point thereupon. For ease of use in a multilingual environment, bottom side 18 of canister positioning plate 12 has a pair of hands 20 imprinted or molded thereunto to illustrate the location of an end-user's hands to effect longitudinal axial actuating movement of the valves positioned upon aerosol canisters A and B for the aerosol components which make up the two component polyurethane foam. Upon longitudinal axial compression, the aerosol system is transformed from its inactive state into an active state ready-for-use due to corresponding longitudinal axial compressive movement of the valves positioned at the top of each aerosol can.

Bottom housing 8 of the two component top housing assembly 4 will have a pair of openings 39 for insertion of the top (valve side) of canisters A and B through bottom side 30 of lower housing 8 with securing frictional engagement with a circular ridge on each dome-shaped circular top 26 of aerosol cans A and B as well as two pairs of resilient flexible upwardly-directioned clips 40 (inner), 50 (outer). Outer clips 50 have a detent 43 for engagement with inwardly facing hook member 45 of downwardly facing latch member 44 which when engaged with detent 43, secure the top 6 and bottom 8 housings of two component top housing assembly 4 together at a predefined spaced apart distance when the dispensing system is in its inactivated state. When transitioning from the inactive to the active state, hook 45 of latch member 44 is disengaged from detent 43 by inward compressive movement of outer clips 50 coupled with further longitudinal axial compression. Complete aerosol activation via aerosol valve depression is achieved when mating engagement is effected between protruding lips 41 on inner clips 40 with lowered top surface 38 after penetration through a pair of receiving apertures 49 disposed on opposed ends of lowered surface 38 and inwardly disposed oval ridge 32 of bottom housing 8 moves via sliding engagement toward the top of raised portion 34. A pair of indentations 2 are disposed within oval ridge 32 and positioned in proximity to ribbed exit port 53 positioned at the top of each outlet for each aerosol can for egress of a flexible plastic tube 52, 54 affixed to each aerosol dispensing valve 46 positioned on top of each valve stem of each aerosol cylinder.

Figure 7:
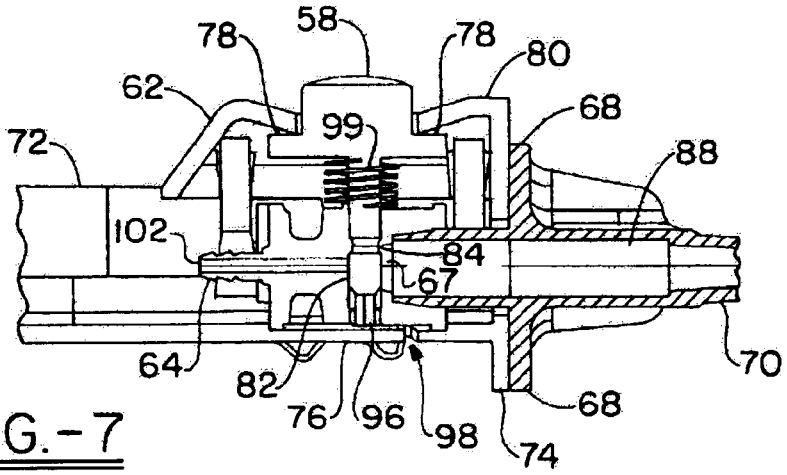
FIG. 7 is an enlarged side elevational view in partial cross-section showing the push button dispensing nozzle in a closed position with supplemental outwardly biased spring.
Figure 8:
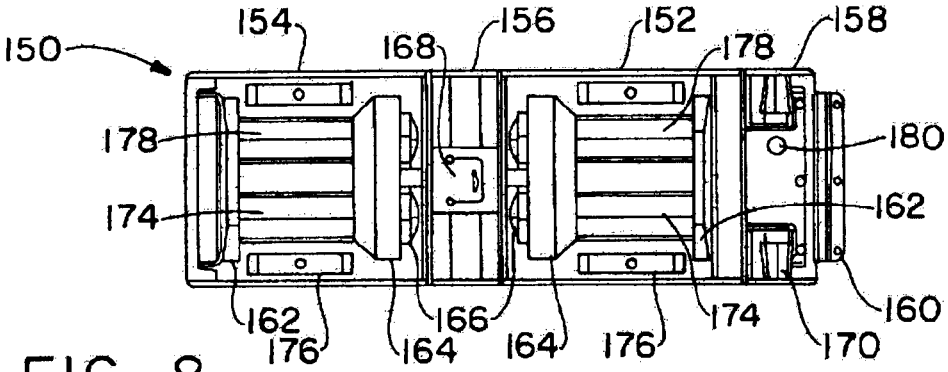
FIG. 8 is a reduced top plan view of a carrying case for the aerosol system.
Figure 9:
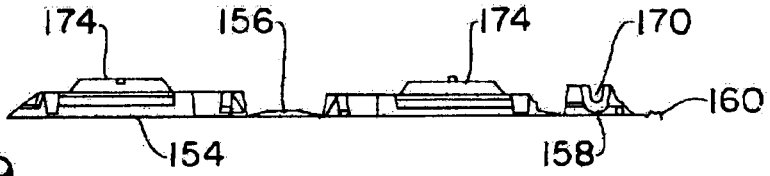
FIG. 9 is a reduced side elevations view of the carrying case of FIG. 8.

As illustrated in FIG. 3, each aerosol dispensing valve 46 has an apertured bottom dimensioned for frictional engagement with an outer periphery of a valve stem of the aerosol can and a ribbed exit port 53 for affixing a plastic hose 52, 54 thereto via securing rings 51 for transporting the contents of either aerosol can A or B to a dispensing nozzle as illustrated in FIGS. 4–5, by egress of said tubing through indentations 2 of oval ridge 32 and cut-out portions 47 of raised portion 34 of upper housing 6. Each tube enters an upper 92 and lower 94 finned rear end 72 of the dispenser 100 through a pair of ribbed inlet ports 64 and secured by a pair of securing rings 63 for ingress of fluid into chamber 56 having a vertically oriented axial bore 55 disposed therethrough (see FIG. 4), a pair of ribbed inlet ports 64 and one outlet bore 67 as illustrated in FIGS. 5–7. Each aerosol dispensing valve 46 is securedly fastened to raised portion 34 by retaining clips (not shown) extending downwardly from the raised portion and which engage a peripheral edge of the dispensing valve.

Dispenser 100 is comprised of a finned rear segment 72, a chamber 56, a centrally apertured 88 front nozzle 70 having an exit bore 90, an upper retaining assembly 62 and a push-bottom 58 actuator. Front nozzle 70 sealed within the dispenser by frictional or rotational screw-like engagement of rearwardly protruding centrally apertured nozzle inlet 66 with chamber exit bore 67 within chamber 56. In its fully inserted position, laterally and peripherally extending shelf 68 of nozzle 70 abuts front shelf 74 of finned rear segment 72 and front shelf 80 of upper retaining assembly 62. Disposed within a forward compartment of rear segment 72 is chamber 56 held in place via insertion of at least one laterally extending projection into a mating recess in the forward compartment. Push-button 58 actuator is positioned and retained within the foam dispenser by laterally extending shelves or wings 78 which abut the apertures overlapping top surface of upper retaining assembly 62 and retaining clips 104. Push-button valve 58 is biased in its closed position, i.e., laterally extending apertures 84 within circular projections 82 are not in fluid alignment with either the centrally disposed inlet bores 102 within ribbed inlet tubes 64 or chamber exit bore 67. Resilient upward biasing is effected by the incorporation of extension piece 96 in contact with a bottom split wall 98 of the dispensing nozzle defining movable resiliently flexible flap 76 of rear segment 72. Only upon positive downward engagement by a user of the nozzle will the horizontal laterally extending apertures 84 with raised lips about a periphery at both ends of the apertures, move into essentially leak-proof fluid alignment with inlet bores 102 and chamber exit bore 67 and nozzle entrance bore 88 egressing through nozzle tip 90. In an optional embodiment the nozzle will further incorporate a secondary biasing means, e.g., a spring 99 for insuring that push button 58 remains in a closed position unless purposefully depressed and activated by an end user.

As an additional safety feature preventing against accidental or premature activation of the canisters through depression of the valves, a safety insert 48 may be incorporated into the assembly. This insert has a pair of legs 42 with extensions 59 which are insertable into receiving apertures 49 positioned within lowered surface 38. With the safety inserted, it is not possible for the inner pair of clips 40 to penetrate through apertures 49 for locking engagement with lowered surface 38.

Dispensing holder assembly 10 is often shipped within packaging or shipping container 150. This foldable container has a pair of sides 152, 154 having a pair of recesses 174, 178 for securing of aerosol canisters A and B as well as top 156 having a movable tab 168 for affixing onto a display hanger and bottom segment 158. Each pair of recesses has a bottom 162 and a top 164, 166 for receiving the canister positioning plate 12 and upper housing 6 and lower housing 8 component of top housing assembly 4 respectively. Recess 170 is available for storage of dispensing nozzle 100.

When dispensing holder assembly 10 with canisters A and B is positioned within container 150, and dispenser 100 is positioned within recess 170, the end user can operate the entire assembly with one hand after activation of the unit by depressing push-button valve 58 which is exposed through opening 180. It should be recognized that when the assembly is used in kit form, the aerosol canisters must be in their inverted position, unless the canisters are equipped with a dip tube. This means that in operation, top segment 156 is at the bottom, whereas bottom segment 158 is positioned at the top so as to enable the end-user to effect fluid transfer when depressing push-button valve 58.

Figure 10:
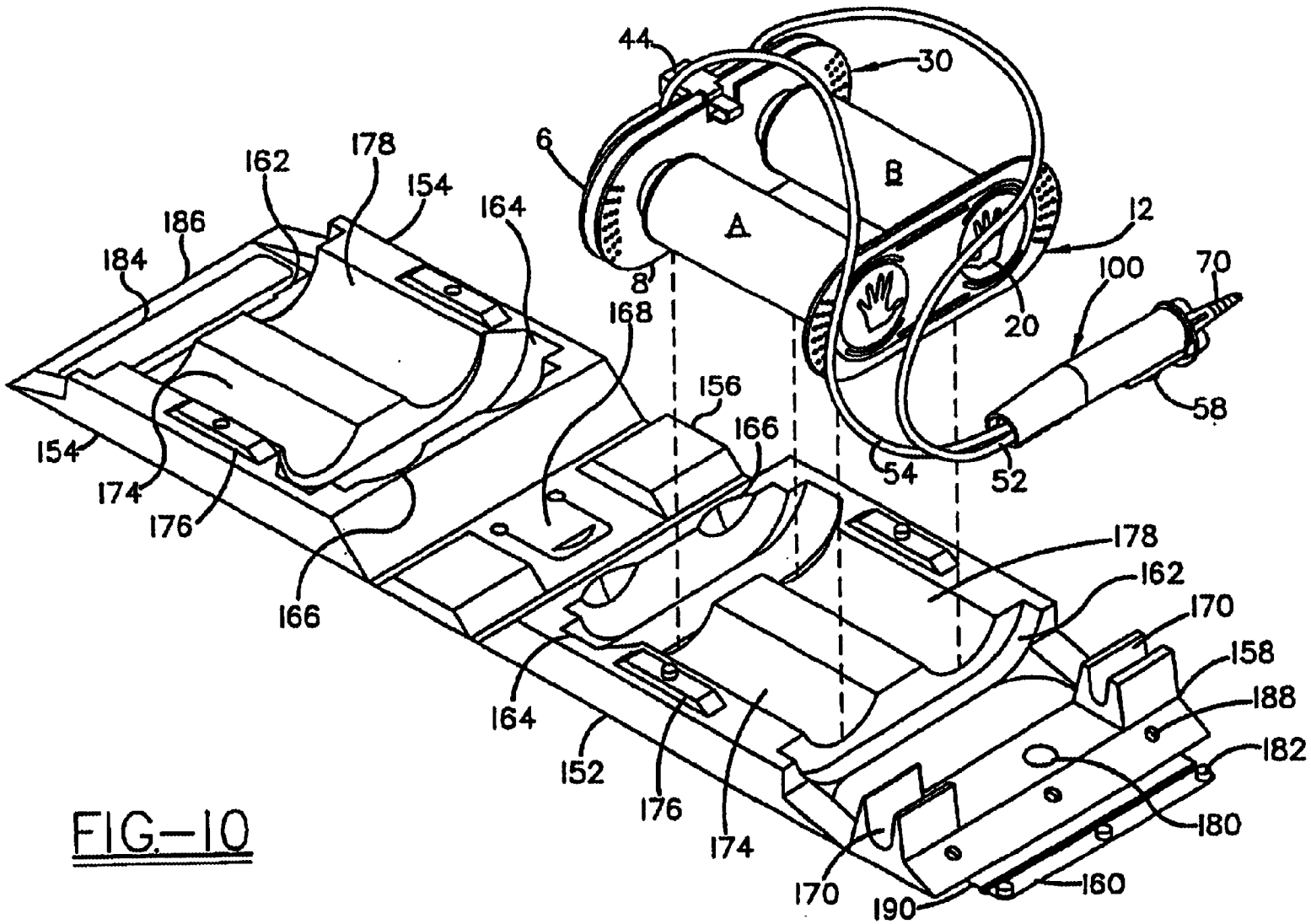
FIG. 10 is an assembly view of the two component system illustrated in FIG. 1 as positioned within the carrying case of FIGS. 8–9.

FIG. 10 illustrates the positioning of the two-component system discussed previously into full expanded kit or shipping container 150. Each of canisters A and B are positioned within recesses 174 and 178 respectively. Upper and lower housings 6 and 8 are respectively positioned within top recess 164 with recessed dome portion 166 for accommodating raised portion 34 of upper housing 6. Cannister positioning plate 12 is positioned within bottom recess 162 while dispenser 100 with front nozzle 70 is positioned within recess 170 with push-button actuator 58 protruding through opening 180. The various designations of "top" and "bottom" were chosen with reference to how the product would hang on a display through movable tab 168, thereby having recesses 164, 166 positioned at the top of the display and recess 162 at the bottom. It is understood that in operation, the kit would be turned upside-down and the designations of "top" and "bottom" would be inverted.

Figure 11:
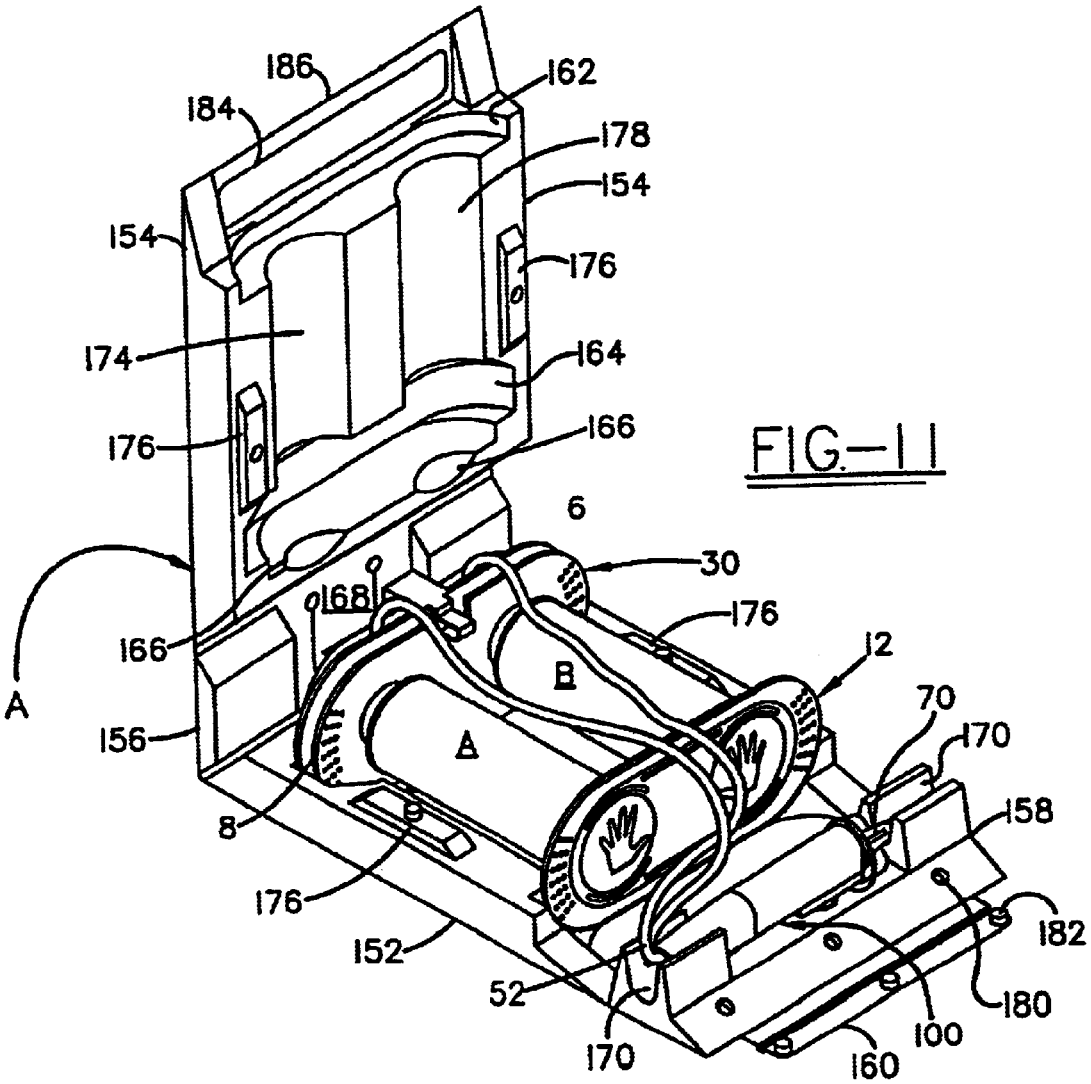
FIG. 11 is a perspective view of FIG. 10 showing the two component system positioned within one portion of the kit and a flap partially closed.
Figure 12:
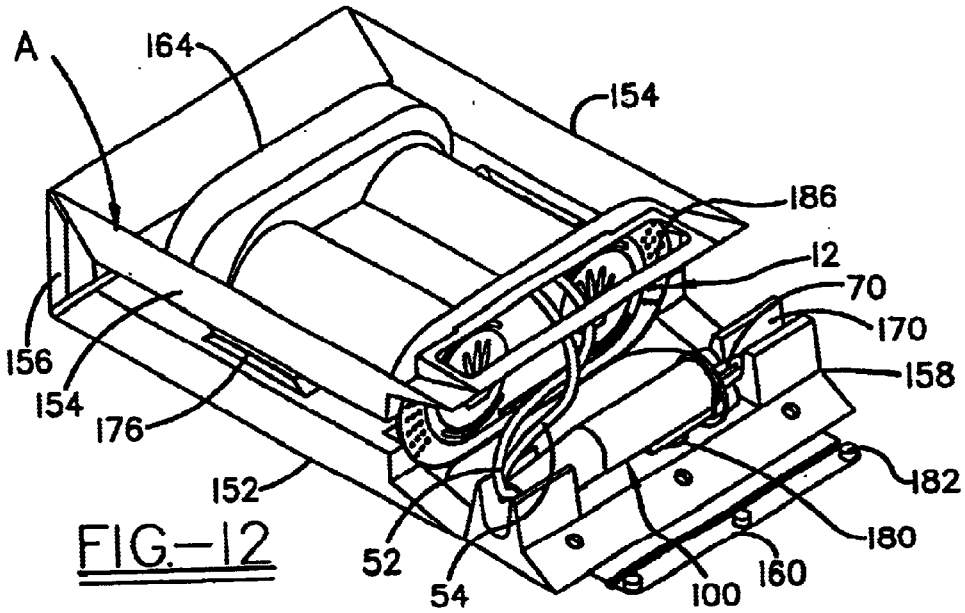
FIG. 12 is a perspective view of FIG. 11 showing the partially closed flap of FIG. 11 in a completely closed position on the two component system.

FIG. 11 illustrates FIG. 10 in which side flap 154 is positioned at approximately 90° to side flap 152 by moving side flap 154 in the direction designated by arrow "A" from its initial horizontal position. Continued clockwise movement along the direction designated by arrow "A" will form a container by mating engagement of side projections 176 and folding of segment 156 to form the "top" as the kit would be hung on a display or a "bottom" as the container would be used in operation.

Figure 13:
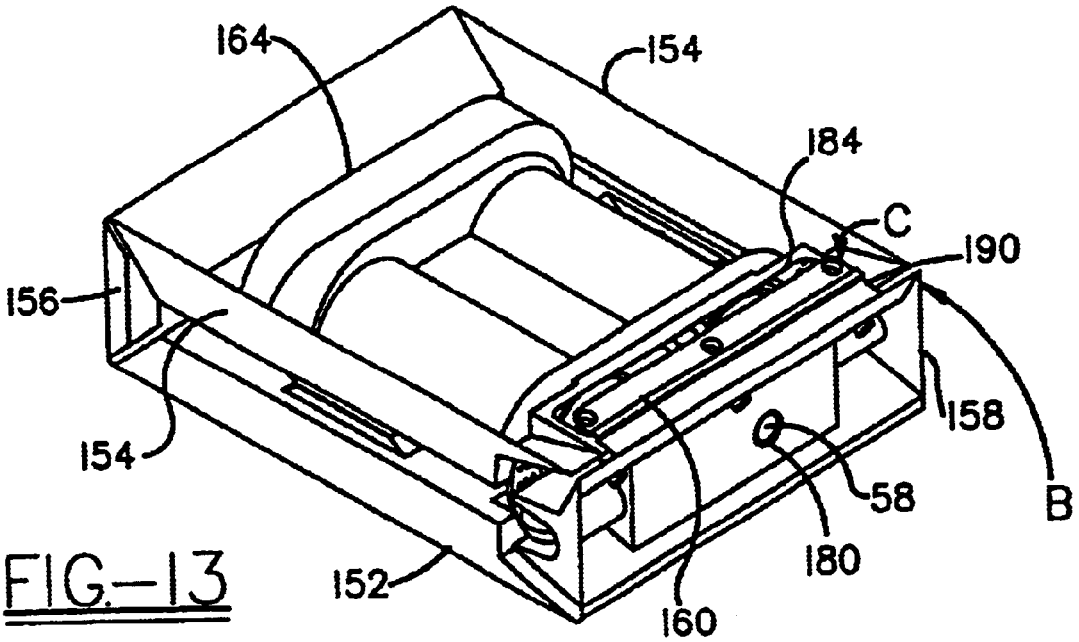
FIG. 13 is a perspective view of FIG. 12 illustrating the bottom segment flap closing about one side flap.
Figure 14:
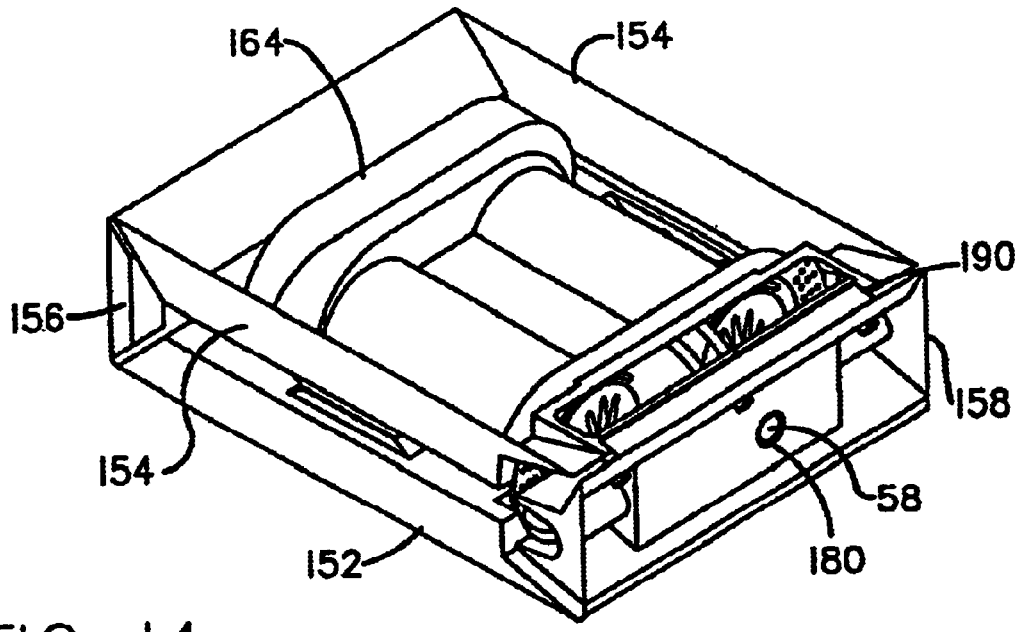
FIG. 14 is a perspective view of FIG. 13 illustrating the bottom segment flap in its completely closed position.

FIG. 13 illustrates the continued folding of shipping container 150 by counter-clockwise rotational movement in the direction designated by arrow "B" of segment 158 about top edge 186 of side flap 154 into opening 184 of said flap. Continued counter-clockwise rotational movement in the direction designated by arrow "C" effects mating engagement of raised male projections 182 on one side of segment 158 with mating female receptacles 188 for securing engagement illustrated in FIG. 14.

While the dispensing holder assembly 10 is preferably used to dispense polyurethane foams, any pressurized fluid (gas, liquid, semi-solid or combinations thereof) is capable of being dispensed. Additionally, the invention is not limited to any one foam or polymer and additionally, is not limited to two canister two-component A and B systems. When the foam to be dispensed is a one-component system, the dispensing apparatus will operate with two canisters, each containing the same or different one-component compositions, and each canister positioned in the locations identified for the A and B components previously. In an alternative embodiment, the assembly will function with only one canister, said canister positioned in either of the two locations indicated previously, or positioned more centrally between those locations.

This invention has been described in detail with reference to specific embodiments thereof, including the respective best modes for carrying out each embodiment. It shall be understood that these illustrations are by way of example and not by way of limitation.

What is claimed is:

1. A device for dispensing a fluid comprising:

(a) a dispensing housing;

(b) a chamber in said housing, said chamber having at least one inlet and at least one outlet, each inlet and each outlet having an essentially centrally disposed bore therethrough;

(c) a means for selective activation of said device from a normally biased off position to an open position to enable fluid communication between said at least one inlet and said at least one outlet wherein said push-button actuator further comprises;

(i) at least one essentially cylindrical projection from a top of said actuator, said cylindrical projection having at least one transverse bore extending therethrough;

(ii) said at least one transverse bore positioned such that upon at least partial longitudinal axial movement, at least a portion of said at least one transverse bore will be in fluid alignment with at least a portion of said at least one inlet and at least a portion of said at least one outlet;

(d) a removable dispensing nozzle having a bore therethrough in fluid communication with said at least one outlet of said chamber; and (e) a biasing means to bias said selective activation means in said biased off position, and further wherein said biasing means is (i) a flap in a bottom side of said housing acting in concert with a projection in contact with a tip of said longitudinally axially extending cylindrical projection.

2. The device of claim 1 wherein said at least one cylindrical projection is two cylindrical projections, each projection having one transverse bore.

3. The device of claim 2 which further comprises (a) a push-button retaining means.

4. The device of claim 3 wherein said retaining means comprises (a) an inwardly extending ledge over at least a portion of a pair of laterally and peripherally extending ledges of said push-button actuator.

5. The device of claim 1 wherein said biasing means is (a) a spring.

6. The device of claim 5 wherein said biasing means comprises (a) a flap in a bottom side of said housing acting in concert with a projection in contact with a tip of said longitudinally axially extending cylindrical projection and a spring.

7. The device of claim 1 which further comprises (a) a housing for at least one aerosol container.

8. The device of claim 7 wherein said housing for said at least one aerosol container further comprises (a) a bottom plate having at least one raised cylindrical ridge in said plate dimensioned to accommodate a bottom diameter of said at least one aerosol container;

(b) a top assembly comprising a lower and an upper housing, said lower housing having an opening dimensioned to accommodate at least partial insertion of a top of said at least one aerosol container, said top assembly further comprising (i) at least one pair of flexible clips which secure said upper and lower housings together upon longitudinal axial compression of said upper and lower housings.

9. The device of claim 8 which further comprises (a) at least one second pair of flexible clips for securing said upper and lower housings of said top assembly in a spaced apart relationship.

10. The device of claim 8 in a kit form, said kit which further comprises an outer housing having (a) a pair of side walls, each side wall having (i) at least one cavity for said at least one aerosol container, (ii) a bottom recess for said upper housing assembly in each side wall, and (iii) a top recess for said plate in each side wall;

(b) each side wall in flexible communication with a top wall;

(c) one side wall in flexible communication with a bottom wall; and (d) said bottom wall in flexible communication with a closure means.

11. The device of claim 10 wherein said bottom wall further comprises (a) a cavity for said nozzle dispensing device.

12. The device of claim 11 wherein (a) said cavity for said nozzle dispensing device has an aperture disposed therein in alignment with said push-button actuator to permit one-handed operation.

13. The device of claim 7 which further comprises (a) a housing for a pair of aerosol containers.

14. The device of claim 13 wherein said housing for said pair of aerosol containers further comprises (a) a bottom plate having a pair of raised cylindrical ridges in said plate dimensioned to accommodate a bottom diameter of each aerosol container;

(b) a top assembly comprising a lower and an upper housing, said lower housing having an opening dimensioned to accommodate at least partial insertion of a top of each aerosol container, said top assembly further comprising (i) at least one pair of flexible clips which secure said upper and lower housings together upon longitudinal axial compression of said upper and lower housings.

15. The device of claim 14 which further comprises (a) at least one second pair of flexible clips for securing said upper and lower housings of said top assembly in a spaced apart relationship.

16. The device of claim 14 wherein said top assembly further comprises a pair of openings to accommodate a pair of tubes emanating from each of a pair of aerosol dispensing valves positioned on each of said aerosol containers.

17. The device of claim 14 in a kit form, said kit which further comprises an outer housing having (a) a pair of side walls, each side wall having (i) a pair of cavities for each aerosol container, (ii) a bottom recesses for said upper housing assembly in each side wall, and (iii) a top recesses for said plate in each side wall;

(b) each side wall in flexible communication with a top wall;

(c) one side wall in flexible communication with a bottom wall; and (d) said bottom wall in flexible communication with a closure means.

18. The device of claim 17 wherein said bottom wall further comprises (a) a cavity for said nozzle dispensing device.

19. The device of claim 18 wherein (a) said cavity for said nozzle dispensing device has an aperture disposed therein in alignment with said push-button actuator to permit one-handed operation.

20. The device of claim 19 wherein said closure means comprises (a) at least one frictionally engaging raised portion with at least one mating recessed portion.

21. A device for dispensing a fluid comprising:

(a) a dispensing housing;

(b) a chamber in said housing, said chamber having at least one inlet and at least one outlet, each inlet and outlet having an essentially centrally disposed bore therethrough;

(c) a means for selective activation of said device from a normally biased off position to an open position to enable fluid communication between said at least one inlet and said at least one outlet of said chamber;

(d) a dispensing nozzle having a bore therethrough in fluid communication with said at least one outlet of said chamber;

(e) a biasing means to bias said selective activation means in said biased off position; and (f) a housing for at least one aerosol container, said housing further comprising (i) a bottom plate having at least one raised cylindrical ridge in said bottom plate dimensioned to accommodate a bottom diameter of said at least one aerosol container;

(ii) a top assembly comprising a lower and an upper housing, said lower housing having an opening dimensioned to accommodate at least partial insertion of a top of said at least one aerosol container, said top assembly further comprising (A) at least one pair of flexible clips which secure said upper and lower housings together upon longitudinal axial compression of said upper and lower housings.

22. The device of claim 21 wherein said means for selective activation further comprises a push-button actuator which further comprises:

(a) at least one essentially cylindrical projection from a top of said actuator, said cylindrical projection having at least one transverse bore extending therethrough, (i) said at least one transverse bore positioned such that upon at least partial longitudinal axial movement, at least a portion of said at least one transverse bore will be in fluid alignment with at least a portion of said at least one inlet and at least a portion of said at least one outlet.

23. The device of claim 22 wherein said at least one essentially cylindrical projection is two cylindrical projections, each projection having one transverse bore.

24. The device of claim 22 which further comprises (a) a push button retaining means.

25. The device of claim 24 wherein said retaining means comprises (a) an inwardly extending ledge over at least a portion of a pair of laterally and peripherally extending ledges of said push-button actuator.

26. The device of claim 22 wherein said biasing means is (a) a flap in a bottom side of said housing acting in concert with said at least one projection in contact with a tip of said at least one longitudinally axially extending cylindrical projection.

27. The device of claim 22 wherein said biasing means is (a) a spring.

28. The device of claim 22 wherein said biasing means comprises (a) a flap in a bottom side of said housing acting in concert with a projection in contact with a tip of said longitudinally axially extending cylindrical projection and a spring.

29. The device of claim 22 in a kit form, said kit which further comprises an outer housing having (a) a pair of side walls, each side wall having (i) at least one cavity for said at least one aerosol container, (ii) a bottom recess for said upper housing assembly in each side wall, and (iii) a top recess for said plate in each side wall;

(b) each side wall in flexible communication with a top wall;

(c) one side wall in flexible communication with a bottom wall; and (d) said bottom wall in flexible communication with a closure means.

30. The device of claim 29 wherein said bottom wall further comprises (a) a cavity for said nozzle dispensing device.

31. The device of claim 30 wherein (a) said cavity for said nozzle dispensing device has an aperture disposed therein in alignment with said push-button actuator to permit one-handed operation.

32. The device of claim 22 which further comprises (a) a housing for a pair of aerosol containers.

33. The device of claim 32 wherein said housing for said pair of aerosol containers further comprises (a) a bottom plate having a pair of raised cylindrical ridges in said plate dimensioned to accommodate a bottom diameter of each aerosol container;

(b) a top assembly comprising a lower and an upper housing, said lower housing having an opening dimensioned to accommodate at least partial insertion of a top of each aerosol container, said top assembly further comprising (i) at least one pair of flexible clips which secure said upper and lower housings together upon longitudinal axial compression of said upper and lower housings.

34. The device of claim 33 which further comprises (a) at least one second pair of flexible clips for securing said upper and lower housings of said top assembly in a spaced apart relationship.

35. The device of claim 33 wherein said top assembly further comprises a pair of openings to accommodate a pair of tubes emanating from each of a pair of aerosol dispensing valves positioned on each of said aerosol containers.

36. The device of claim 33 in a kit form, said kit which further comprises an outer housing having (a) a pair of side walls, each side wall having (i) a pair of cavities for each aerosol container, (ii) a bottom recesses for said upper housing assembly in each side wall, and (iii) a top recesses for said plate in each side wall;

(b) each side wall in flexible communication with a top wall;

(c) one side wall in flexible communication with a bottom wall; and (d) said bottom wall in flexible communication with a closure means.

37. The device of claim 36 wherein said bottom wall further comprises (a) a cavity for said nozzle dispensing device.

38. The device of claim 37 wherein (a) said cavity for said nozzle dispensing device has an aperture disposed therein in alignment with said push-button actuator to permit one-handed operation.

39. The device of claim 38 wherein said closure means comprises (a) at least one frictionally engaging raised portion with at least one mating recessed portion.

40. A kit for dispensing a fluid comprising:

(a) a dispensing housing;

(b) a chamber in said housing, said chamber having at least one inlet and at least one outlet, each inlet and outlet having an essentially centrally disposed bore therethrough;

(c) a means for selective activation of said device from a normally biased off position to an open position to enable fluid communication between said at least one inlet and said at least one outlet;

(d) a dispensing nozzle having a bore therethrough in fluid communication with said at least one outlet of said chamber;

(e) a biasing means to bias said selective activation means in said biased off position; and (f) a housing for at least one aerosol container, said housing further comprising (i) a bottom plate having at least one raised cylindrical ridge in said bottom plate dimensioned to accommodate a bottom diameter of said at least one aerosol container;

(ii) a top assembly comprising a lower and an upper housing, said lower housing having an opening dimensioned to accommodate at least partial insertion of a top of said at least one aerosol container, said top assembly further comprising (A) at least one pair of flexible clips which secure said upper and lower housings together upon longitudinal axial compression of said upper and lower housings; and (g) a carrying case comprising (i) a pair of side walls, each side wall having (A) at least one cavity for said at least one aerosol container, (B) a bottom recess for said upper housing assembly in each side wall, (C) a top recess for said plate in each side wall, (ii) each side wall in flexible communication with a top wall;

(iii) one side wall in flexible communication with a bottom wall; and (iv) said bottom wall in flexible communication with a closure means.

41. The device of claim 40 wherein said means for selective activation further comprises a push-button actuator which further comprises:

(a) at least one essentially cylindrical projection from said top, said cylindrical projection having at least one transverse bore extending therethrough, (i) said at least one transverse bore positioned such that upon at least partial longitudinal axial movement, at least a portion of said at least one transverse bore will be in fluid alignment with at least a portion of said at least one inlet and at least a portion of said at least one outlet.

42. The device of claim 41 wherein said at least one essentially cylindrical projection is two cylindrical projections, each projection having one transverse bore.

43. The device of claim 41 which further comprises (a) a push-button retaining means.

44. The device of claim 43 wherein said retaining means comprises (a) an inwardly extending ledge over at least a portion of a laterally and peripherally extending ledge of said push-button actuator.

45. The device of claim 41 wherein said biasing means is (a) a flap in a bottom side of said housing acting in concert with a projection in contact with a tip of said longitudinally axially extending cylindrical projection.

46. The device of claim 41 wherein said biasing means is (a) a spring.

47. The device of claim 41 wherein said biasing means comprises (a) a flap in a bottom side of said housing acting in concert with a projection in contact with a tip of said longitudinally axially extending cylindrical projection and a spring.

48. The device of claim 41 which further comprises (a) at least one second pair of flexible clips for securing said upper and lower housings of said top assembly in a spaced apart relationship.

49. The device of claim 41 wherein said bottom wall further comprises (a) a cavity for said nozzle dispensing device.

50. The device of claim 49 wherein (a) said cavity for said nozzle dispensing device has an aperture disposed therein in alignment with said push-button actuator to permit one-handed operation.

51. The device of claim 41 which further comprises (a) a housing for a pair of aerosol containers.

52. The device of claim 51 wherein said housing for said pair of aerosol containers further comprises (a) a bottom plate having a pair of raised cylindrical ridges in said plate dimensioned to accommodate a bottom diameter of each aerosol container;

(b) a top assembly comprising a lower and an upper housing, said lower housing having an opening dimensioned to accommodate at least partial insertion of a top of each aerosol container, said top assembly further comprising (i) at least one pair of flexible clips which secure said upper and lower housings together upon longitudinal axial compression of said upper and lower housings.

53. The device of claim 52 which further comprises (a) at least one second pair of flexible clips for securing said upper and lower housings of said top assembly in a spaced apart relationship.

54. The device of claim 52 wherein said top assembly further comprises (a) a pair of openings to accommodate a pair of tubes emanating from each of a pair of aerosol dispensing valves positioned on each of said aerosol containers.

55. The device of claim 52 wherein said bottom wall further comprises (a) a cavity for said nozzle dispensing device.

56. The device of claim 55 wherein (a) said cavity for said nozzle dispensing device has an aperture disposed therein in alignment with said push-button actuator to permit one-handed operation.

57. The device of claim 56 wherein said closure means comprises (a) at least one frictionally engaging raised portion with at least one mating recessed portion.

* * * * *